US008840236B2

(12) United States Patent
Thompson

(10) Patent No.: US 8,840,236 B2
(45) Date of Patent: Sep. 23, 2014

(54) DIGITAL CURING METHODS AND SYSTEMS FOR ENERGY EFFICIENT PACKAGE PRINTING USING RADIAITON CURABLE INKS

(75) Inventor: Michael D. Thompson, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 51 days.

(21) Appl. No.: 13/284,331

(22) Filed: Oct. 28, 2011

(65) Prior Publication Data

US 2013/0106966 A1 May 2, 2013

(51) Int. Cl.

| | |
|---|---|
| ***B41J 2/01*** | (2006.01) |
| ***B41M 7/00*** | (2006.01) |
| ***B41J 11/00*** | (2006.01) |

(52) U.S. Cl.

CPC ..... *B41M 7/0081* (2013.01); *B41J 11/002* (2013.01); *B41J 11/0085* (2013.01)

USPC ..... 347/102; 347/101

(58) Field of Classification Search

CPC ..... B41J 11/002; B41J 11/0015; B41J 2/01; B41M 7/0072; C09D 11/101

USPC ..... 347/102, 262, 101, 104; 101/456

See application file for complete search history.

(56) References Cited

U.S. PATENT DOCUMENTS

| | | | | |
|---|---|---|---|---|
| 6,562,413 | B1 * | 5/2003 | Morgavi | 427/466 |
| 6,570,604 | B2 * | 5/2003 | Able et al. | 347/262 |
| 2002/0100385 | A1 * | 8/2002 | Yamasaki | 101/456 |
| 2004/0085423 | A1 * | 5/2004 | Bronstein et al. | 347/102 |
| 2007/0115335 | A1 * | 5/2007 | Vosahlo et al. | 347/102 |

* cited by examiner

*Primary Examiner* — Manish S Shah
*Assistant Examiner* — Yaovi Ameh
(74) *Attorney, Agent, or Firm* — Ronald E. Prass, Jr.; Prass LLP

(57) ABSTRACT

A digital curing system includes a raster scanning apparatus and a laser diode. The raster scanning apparatus scans an image with light emitted by the laser diode to digitally address the image with appropriate amounts of light to cure portions of the image as desired.

1 Claim, 2 Drawing Sheets

DIGITAL CURING METHODS AND SYSTEMS FOR ENERGY EFFICIENT PACKAGE PRINTING USING RADIAITON CURABLE INKS

FIELD OF DISCLOSURE

This disclosure relates to curing radiation curable inks, including radiation curable phase change gel inks. In particular, the disclosure relates to digitally curing radiation curable ink on a substrate using a raster approach.

BACKGROUND

Radiation curable phase change gel inks may be used to form images on substrates in printing. The ink may be exposed to radiation to cure the ink. Exemplary radiation-curing techniques include, but are not limited to, curing using ultraviolet (UV) light, for example having a wavelength of approximately 240-450 nm or more rarely visible light, optionally in the presence of photoinitiators and/or sensitizers, curing using thermal curing, in the presence or absence of high-temperature thermal initiators (and which may be largely inactive at the jetting temperature), and appropriate combinations thereof.

During this exposure, photoinitiator substances contained in the ink may be irradiated with the UV radiation, and the incident flux converts monomers in the ink into a cross-linked polymer matrix, resulting in a hard and durable mark on the substrate. For some applications, it may be desirable to spread or level the ink on the substrate before curing. Leveling can produce more-uniform image gloss and mask missing jets of print heads. Additionally, certain print applications, such as packaging, may benefit from having thin ink layers of relatively constant thickness in prints.

UV curable inks are used for many applications for which a durable printed image is desired, such as packaging applications. An important class of UV curable inks includes acrylate monomers, oligomers, specific photoinitiators, and other components that react chemically when exposed to UV light energy and form a polymerized, cross-linked, durable image. This curing process is applied to UV curable images formed by, for example, flexography, offset, and inkjet systems.

In related systems, a flood mercury arc lamp is used to irradiate and cure UV ink images during printing. The mercury lamps may be doped variously with, e.g., iron or gallium. These lamps are expensive, typically costing $15,000 or more depending on width and manufacturer as of the filing date of this application. Moreover, such lamps waste energy during a print job by illuminating an entire image area on a substrate, including areas that do not include ink to be cured. The lamps emit light at high power in a broad spectrum of frequencies, most of which are not beneficial to the curing process. At high printing speeds, multiple lamps are used. A power needed to cure the ink is set high enough to cure the most difficult-to-cure color of ink or thickest layer of ink.

SUMMARY

It is desirable to cure specific portions of an ink image with appropriate levels of power, thereby saving energy and enabling further image processing, such as gloss control. In an embodiment, methods may include digitally scanning an image with UV light for curing ink of the image. Methods may include scanning a first portion of ink with light emitted by a laser diode at a first power level.

In an embodiment, methods may include emitting light from the laser diode at the first power level or second power level. Methods may include controlling the laser diode for the emitting based on image data. Methods may include scanning a second portion of the ink with laser diode light emitted at a second power level. Methods may include scanning a first portion of an image and scanning a second portion of an image wherein the first image portion comprises a first color ink, the first power level being suitable for curing the first color ink; and the second image portion comprises a second color ink, the second power level being suitable for curing the second color ink.

Methods may include scanning a first portion of an image and scanning a second portion of an image wherein the first image portion comprises an ink layer having a first thickness, and the second image portion comprises an ink layer having a second thickness, the first power level being suitable for curing ink in a layer having the first thickness, and the second power level being suitable for ink in a layer having the second thickness.

In an embodiment, digital curing systems may include a light source; and a raster scanning apparatus being configured to scan an image with light emitted by the light source, and re-directed by the scanning apparatus. Systems may include the scanning apparatus comprising a polygon mirror, the polygon mirror being configured to rotate and re-direct light emitted by the light source; and a scanning lens, the scanning lens configured to re-direct light from the mirror to the image.

In an embodiment, the light source may comprise a UV light source such as a laser diode lasing at an appropriate wavelength. In an alternative embodiment, the light source may comprise an LED. Systems may include a plurality of light sources and associated raster scanning apparatus.

In an embodiment, the light source(s) may be adjustable for outputting light at a desired power level. For example, the light source may be adjustably configured to emit light at a second power and a first power. In an embodiment, systems may include a controller being coupled to at least one of the light source and the scanning apparatus, the controller being configured to at least one of control a speed of a rotatable mirror of the scanning apparatus, and control a power at which the light source outputs light.

The digital curing system may be to digitally address an image to preferentially cure ink of the image. For example, the light source and scanning system may be configured to digitally address the image based on image data. The image data may include power level data associated with respective image portions for addressing the respective portions with light output at an appropriate amount of power for curing.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
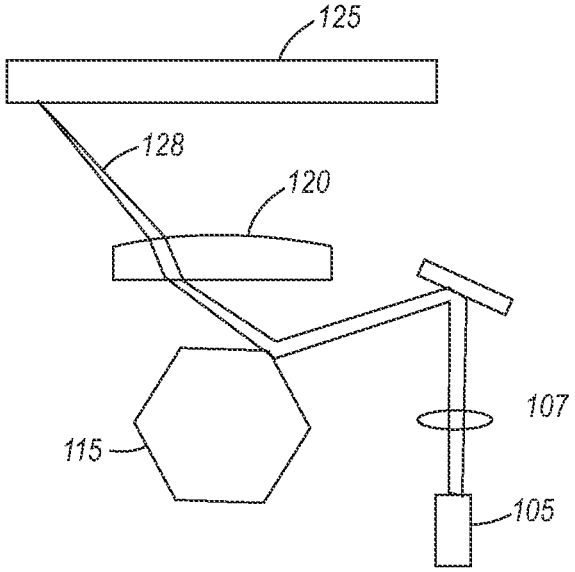
FIG. 1 shows a diagrammatical view of a digital curing system in accordance with an embodiment.

Exemplary embodiments are intended to cover all alternatives, modifications, and equivalents as may be included within the spirit and scope of the apparatus and systems as described herein.

Reference is made to the drawings to accommodate understanding of methods and systems for digitally curing a radiation curable gel ink image. In the drawings, like reference numerals are used throughout to designate similar or identical elements. The drawings depict various embodiments and data related to embodiments of illustrative methods and system for radiation curable gel ink printing, including method and systems for digitally curing radiation curable ink.

Digital curing systems in accordance with an embodiment may include laser diodes for irradiating radiation curable ink. For example, the laser diodes may emit UV light, and may be laser diodes of the type that are typically implemented in high-definition multimedia optical drives such as BLU-RAY disc burners. Such lasers are typically configured to lase at about 405 nanometers. Any laser diode that may be configured to output about 100 mW to about 200 mW of power may be implemented. Lasers that apply light having a wavelength of about 365 nm may be used. Similar, lasers that apply light having a wavelength of about 385 nm may be used. In an alternative embodiment, light emitting diodes may be implemented. An energy density required to fully cure a radiation curable ink image may be about 25 mjoules/$cm^2$. Accordingly, a plurality of lasers may be implemented. Digital curing systems in accordance with embodiments implement radiation sources that are less expensive and more efficient for irradiation of ink for a print job than related art mercury flood lamps, for example, which are used to illuminate an entire image area with a broad spectrum of light frequencies at a substantially constant power.

Further, systems in accordance with an embodiment may include a raster arrangement as used in laser electrophotographic printing systems. In particular, systems may include a polygon mirror that spins for raster scanning. Accordingly, systems may be configured to digitally address UV light to the ink image for curing specific portions of the image with an appropriate power. For example, the system may be configured to apply emit light at a first power to cure a first ink color and/or thickness, and emit light at a second power to cure a second ink color and/or thickness that is different from the first ink color and/or thickness. The system may be configured to apply no power for an image area wherein no ink is to be cured. The laser treatment may be addressable on a pixel-by-pixel basis. For example, a polygon mirror may be associated with a laser diode for scanning an image, or a portion of an image, with light from the single laser diode source. Scanning an image or image portion with light from a single diode source accommodates enhanced pixel-to-pixel uniformity, and gloss control. Digital curing systems may include one or more laser diode(s), each with associated raster scanning apparatus.

For example, a single mirror may be used for multiple beams. Alternatively, a digital micro mirror array may be implemented for scanning the laser beam. A controller may be configured to control the light and/or scanner apparatus in accordance with image data. The image data may include data such as appropriate radiation source power levels and corresponding image data portions and/or, e.g., pixels addresses for a particular image(s). The image data may be stored in memory.

Methods for digitally curing an image in accordance with an embodiment may include irradiating an ink image with a laser diode. Methods may include scanning the image with light emitted by the laser diode. Methods may include scanning the image with light emitted by the laser diode in accordance with image data. The image data may indicate portions of an image and respective curing requirements including, e.g., appropriate power level for applying a desired amount of light to enable a desired amount of cure. For example, an image may be partially cured, or pinned. An image may be fully cured. The data may be used to digitally address the ink image while allowing for application of appropriate levels of power for appropriate portions of the image. The data may be image data that is electronically stored.

In an embodiment, methods may include scanning a first ink image portion with light emitted by a laser diode at a first power level, such as 10 mW, scanning a second ink image portion with light emitted by a laser diode at a second power level, such as 100 mW.

Methods may include curing ink at an ink image portion corresponding to a first pixel of the image at a first power level, and curing ink at an ink image portion corresponding to a second pixel of the image a second power level. A laser diode may be implemented for curing the image, the laser diode being configured with a spinning polygon mirror for raster scanning the image. The curing the first pixel and the curing the second pixel may be accommodated by irradiating the ink with UV light from the laser diode. If the two pixels require different levels of energy for curing, then the system may cure the first pixel using a light source set at a first power level, and cure the second pixel using a light source set at a second power level. In alternative embodiments, a plurality of laser diodes may be used to cure a single image. A spot size of the laser diode light may be larger than the spot size typically used for, e.g., laser printing. The spot size should large enough to provide an amount of irradiance that is adequate for curing a desired portion of the ink image. An exemplary spot size may be, for example, 3 mm in diameter.

FIG. 1 shows a diagrammatical view of a digital curing system in accordance with an embodiment. FIG. 1 shows a laser 105. The laser 105 may be a laser diode that is configured to emit UV light. The laser may be configured to lase at about 405 nm. Alternatively, the laser may be configured to lase at about 365 nm, or about 385 nm. In an alternative embodiment, a UV light emitting diode may be implemented as radiation source. For example, a high power UV LED, appropriately focuses, may be implemented for curing, e.g., narrow spectral response inks.

The laser 105 is associated with a raster scanning apparatus. In particular, the laser 105 may be associated with an objective lens 107, a scanner 115, and a scanning lens 120. The scanner 115 may be a spinning polygon mirror. The mirror may be coated with a dielectric coating. The scanner may be configured to redirect light from the laser 105 to pass through the scanning lens 120, and onto an image 125. The image or portions thereof may be scanned to deliver enough power and energy to cure or partially cure the ink of the image.

The raster scanning system may scan portions of the image 125 in accordance with image data so that an appropriate level of power and energy may be delivered to appropriate portions of the image. For example, an amplitude or power of light from the laser 105 may be controlled to deliver a desired power to a desired portion of the image. In an image includes 10% ink coverage, then only the 10% of the image containing ink may be cured with a desired level of power, while the remaining 90% of the image may receive no laser treatment. The raster scanning apparatus including the scanner 115 may be implemented to direct light emitted by the laser to desired portions of the image 125. Based on image data, curing treatment may be addressed to certain image portions. The ink image may be digitally addressed to allow for appropriate UV light treatment for a particular curing job and/or image portion.

Figure 2:
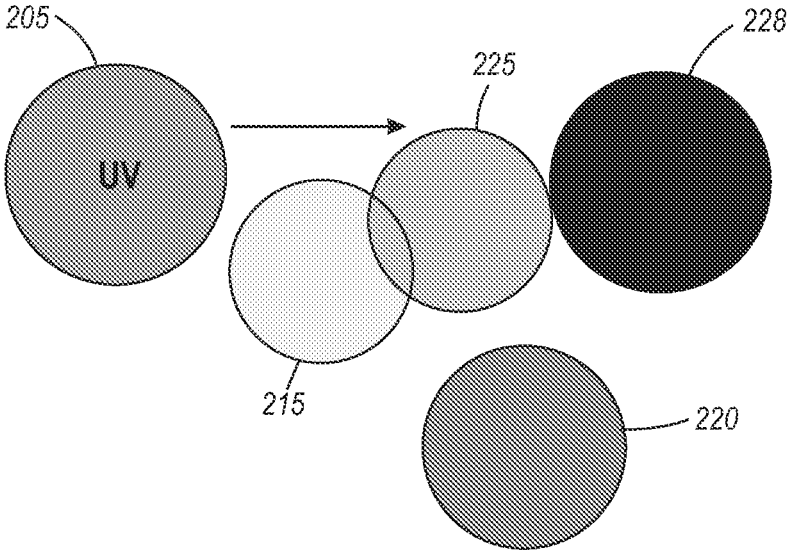
FIG. 2 shows a diagrammatical view of a digital curing process in which a laser spot cures portions of a radiation curable ink image in accordance with an embodiment.

FIG. 2 shows a diagrammatical view a laser diode light spot on an image having ink spots of four different colors. Methods may include digitally addressing the ink image to allow for appropriate levels of power to be applied to desired image portions to, e.g., save energy and enable enhanced gloss control. FIG. 2 shows a UV light spot 205 guided by the scanner 115 during a curing process. FIG. shows spot curing as enabled by a raster scanning apparatus. The image of FIG. 2 shows a yellow ink spot 215, a cyan ink spot 220, a magenta ink spot 225, and a black ink spot 228. Each of the different colored ink spots may be cured or partially cured by a laser diode emitting light.

Each ink color spot may require the laser diode to emit light at a particular power level for effective curing. For example, ink spot 220 may require a higher level of power than ink spot 215. The laser diode and scanner system may be configured to scan the image and apply light to the ink spot 215 at a first power level suitable for curing. The laser diode may be adjusted to output light at a higher second power level for curing the ink spot 220. For portions of the image where there is no ink to be cured, the laser may be configured to not apply UV light. The image may be cured digitally based on image data. The image may be cured on a pixel-by-pixel basis. One or more laser and associated raster scanning apparatus may be implemented for carrying out methods in accordance with an embodiment.

Figure 3:
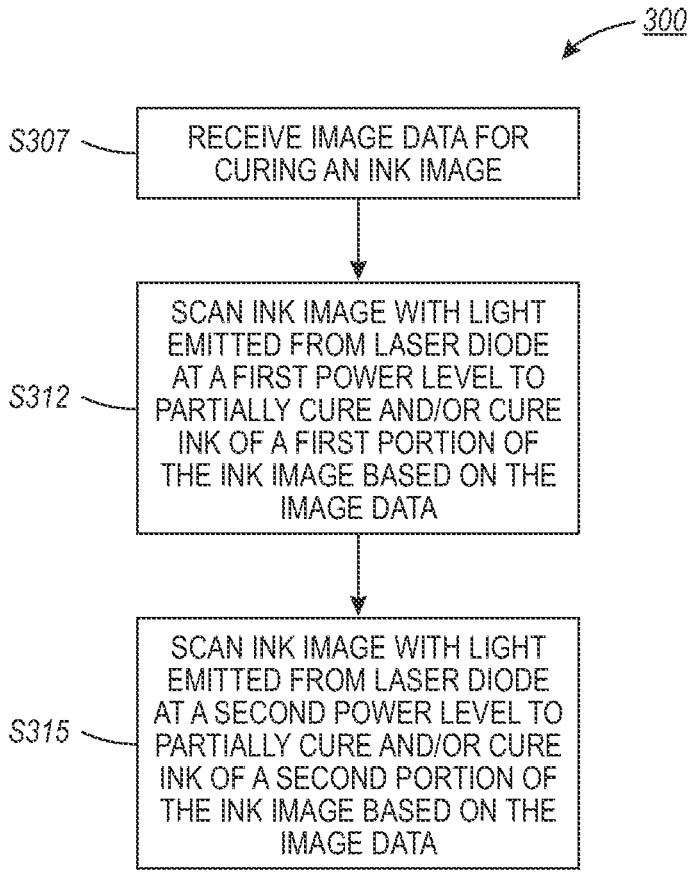
FIG. 3 shows a digital spot curing process in accordance with an exemplary embodiment.

FIG. 3 shows methods for digitally curing a radiation curable ink image in accordance with an embodiment. A printing process as shown in FIG. 3 may include receiving image data at S307. The image data may be stored in memory and communicated to a controller that is configured to control one or more raster scanning apparatus and associated laser diode(s). The image data may include appropriate UV light irradiance and/or light source power level(s) in relation to corresponding image portions of an ink image to be cured. The power levels may be addressed to the image. For example, a first power level may correspond to a first ink color or thickness on a first portion of an image to be cured. A second power level may correspond to a second ink color or thickness on a second portion of the image to be cured. The second power level may be higher or lower than the first power level. The system may thus be configured to apply appropriate levels of power for appropriate portions of an image to be cured. For areas of an image that do not include ink, for example, the laser diode may be controlled whereby light is not emitted and scanned onto such portions. Methods and systems accommodate enhanced gloss control and energy efficiency. Further, because light is scanned from a single laser source by an associated raster scanning apparatus, enhanced pixel-to-pixel uniformity may be achieved.

At S315, the image may be scanned with light emitted from a laser diode at a power level that is appropriate for applying a desired cure to a first portion of an image. The laser and scanner may be configured to preferentially scan the first portion. The first portion may include, for example, ink of a first color or thickness. The laser and scanning system may be configured to scan the first portion based on image data received at S307.

At S315, the image may be scanned with light emitted form a laser diode at a power level that is appropriate for applying a desired cure to a second portion of the image. The laser and scanning apparatus may be configured to preferentially scan the second portion. The second portion may include, for example, ink of a second color or thickness. The power level at which light is emitted form the light source for scanning the second portion at S315 may different than the power level at which light is emitted from the light source for scanning the first portion at S312.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A digital curing method for digitally scanning an ink image with UV light for selectively curing ink of the image on a pixel-by-pixel basis, the method comprising:

scanning a first portion of ink of the ink image with light emitted by an LED at a first power level, the first portion corresponding to a first pixel of the ink image while controlling the LED to emit light from the LED at the first power level based on digital image data corresponding to the ink image, the scanning the first portion of ink comprising:

rotating the light emitted by the LED using a polygon mirror or a scanning lens, and re-directing the light from the mirror to the ink image using the mirror or the scanning lens; and scanning a second portion of the ink of the ink image with LED light emitted at a second power level, the second portion corresponding to a second pixel of the ink image while controlling the LED to emit light at the second power level from the LED based on digital image data, wherein the first image portion comprises an ink layer having a first thickness or a first color, and the second image portion comprises an ink layer having a second thickness or a second color, the first power level being suitable for curing ink in a layer having the first thickness or the first color, and the second power level being suitable for curing ink in a layer having the second thickness or the second color, the scanning the second portion of ink comprising:

rotating the light emitted by the LED using a polygon mirror or a scanning lens, and re-directing the light from the mirror to the ink image using the mirror or the scanning lens.

* * * * *